US006574802B2

(12) United States Patent
Chiang

(10) Patent No.: US 6,574,802 B2
(45) Date of Patent: Jun. 10, 2003

(54) DUAL SINGLE-EYE SWIMMING GOGGLES SYSTEM

(76) Inventor: Herman Chiang, 11-F, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/825,213

(22) Filed: Apr. 2, 2001

(65) Prior Publication Data

US 2002/0138898 A1 Oct. 3, 2002

(51) Int. Cl.[7] ..... A61F 9/02
(52) U.S. Cl. ..... 2/428
(58) Field of Search ..... 2/428, 440, 444, 2/430, 452; 351/43

(56) References Cited

U.S. PATENT DOCUMENTS 5,303,428 A * 4/1994 Pernicka ..... 2/452
5,727,259 A * 3/1998 Kawamata ..... 2/452
6,321,391 B1 * 11/2001 Basso ..... 2/452

* cited by examiner

*Primary Examiner*—John J. Calvert
*Assistant Examiner*—Katherine Moran
(74) *Attorney, Agent, or Firm*—Troxell Law Office PLLC

(57) ABSTRACT

A dual single-eye swimming goggles system for swimming pool purposes comprising: a first single-eye swimming goggle and a second single-eye swimming goggle as well as a method for wearing single-eye swimming goggles on a wearer's head. Each single-eye swimming goggles having a lens frame with a lens fixed therein, and a head strap means mounted to the lens frame. Each single-eye swimming goggle can respectively be adjusted to match the periphery of a wearer's eyehole, so both eyes of a user are more comfortable during use the dual single-eye swimming goggles; and to prevent consequently the seepage of water.

7 Claims, 6 Drawing Sheets

DUAL SINGLE-EYE SWIMMING GOGGLES SYSTEM

FIELD OF THE INVENTION

The present invention relates to a swimming goggles and particularly to a dual single-eye swimming goggles for being worn on the periphery of eyehole respectively, to conform with a wearer's eyehole contour, and to provide more secure and comfortable fitting when the dual single-eye swimming goggles are in use.

BACKGROUND OF THE INVENTION

Conventionally, a swimming goggles has an adjustment element for adjusting a span between a left lens frame and a right lens frame. This is so because the span between two eyes as well as the eyehole's contour may be different from person to person. In addition, the swimming goggles has gaskets for contacting with periphery of a wearer's eyehole, in order to get comfortable and prevent the seepage of water However, the left lens frame and the right lens frame always connect together by a bridge in all types of swimming goggles, which makes the left lens frame and the right lens frame influence each other when adjusting a span of the bridge. In other words, adjusting one of the lens frame to be in conformity with the periphery of left eyehole or right eyehole will move the other lens frame during the adjustment of the span after the swimming goggles are worn on the wearer's eyeholes. Hence, the left lens frame and right lens frame never respectively match the wearer's eyehole contour since the left lens frame and the right lens frame influence each other during the adjustment of span, thereby resulting in the lens frame being not able to seal the periphery of each eyehole and leading to the formation of a gap between each of the lens frames and the seepage of water when swimming goggles are in use.

OBJECTS OF THE INVENTION

Therefore, the object of the present invention is to provide a dual single-eye swimming goggles system that can overcome the drawback of the aforementioned prior art.

More specifically, the main object of the present invention is to provide a dual single-eye swimming goggles system which respectively conform with the periphery of each eyehole of wearer when each single-eye swimming goggle in use, and which never influence the adjustment of span of each single-eye swimming goggle each other, to provide securely matching with the periphery of eyehole respectively and get more comfortable and effective fitting when the dual single-eye swimming goggles are in use.

Another object of the present invention is provide to a dual single-eye swimmig goggles which has a method for wearing each single-eye swimming goggle on a periphery of a wearer's eyeholes respectively, differing from the prior art which wear both lens frame of a swimming goggles on a wearer's eyeholes together. Thereby resulting in each single-eye swimming goggles can seal up the periphery of a wearer's eyehole and prevent the seepage of water when in use.

To achieve the above objects, the present invention features a dual single-eye swimming goggles system having a first single-eye swimming goggle and a second single-eye swimming goggle which respectively are worn on a wearer's periphery of eyehole, each single-eye swimming goggles comprising a lens frame with a lens fixed therein, and a head strap meaniis mounted to the lens frame.

According to the above features of the present invention, the lens frame has a groove formed in the outer periphery thereof. In addition, the head strap mean comprising a strap and a fastener, the strap has a receiving hole coupled to the groove of the lens frame, and has two ends passing through the fastener.

In an aspect of the present invention, between the head strap mean of each single-eye swimming goggles further comprising a flexible thread connection element having two ends which are respectively disposed the fastener of each head strap means for linking them together.

Another feature of the present invention is to provide a dual single-eye swimming goggles system having a method for wearing each single-eye swimming goggles on wearer's head, comprising a first step and a second step respectively for wearing each single-eye swimming goggle on the periphery of a wearer's eye-hole, and having an adjustment step for adjusting each single-eye swimming goggle to conform with the periphery of a wearer's eye-hole respectively According to another feature of the present invention, the adjustment step includes respectively adjusting each strap and single-eye swimnming goggles after the first step and second step are processed.

BRIEF DESCRIPTION OF THE DRAWINGS

Other features and advantages of the present invention will become apparent in the following detailed description of the preferred embodiments with reference to the accompanying drawings of which.

DETAILED DESCRIPTIION OF THE PREFERRED EMBODIMENT

Figure 1:
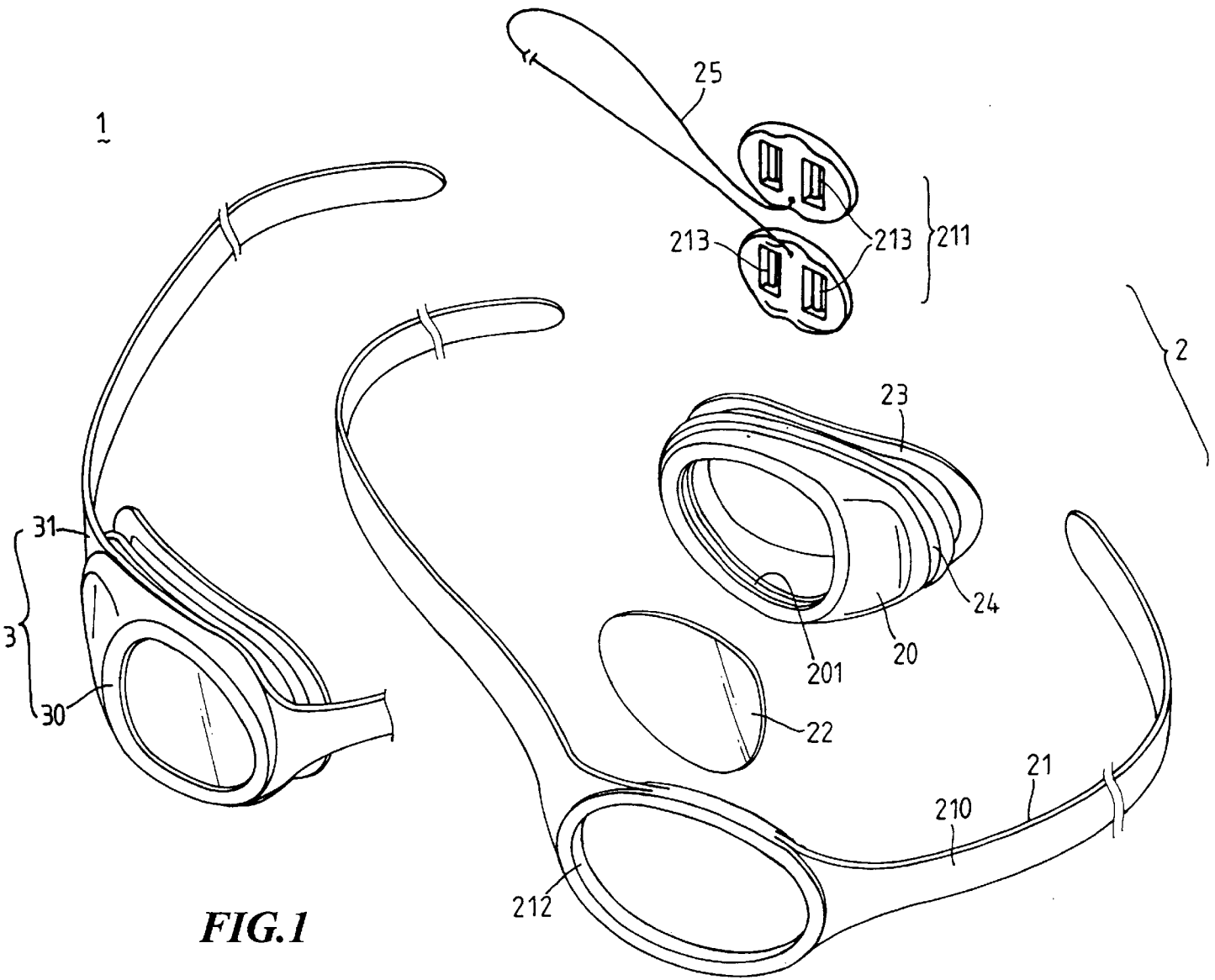
FIG. 1 is a perspective view of the disassembled parts of the dual single-eye swimming goggles of the present invention.

Referring to FIG. 1, the preferred embodiment of a dual single-eye swimming goggles according to the present invention is show to comprise a first single-eye swimming goggle 2 and a second single-eye swimming goggle 3, each single-eye swimming goggle 2 and 3 respectively includes a lens frames 20,30 and a head strap means 21,31. The first single-eye swimming goggle 2 is the same with the second single-eye swimming goggle 3 in structure. Here just introduces the disassembled of single-eye swimming goggle 2 in order to explain convenient to understanding. As shown in FIG. 1, the lens frame 20 has an inner periphery 201 that defines a retaining space for a lens unit 22. An integrally formed gasket 23 near a face-contacting side of the lens frame 20. A groove 24 formed in an outer periphery of the lens frame 20. The head strap means 21 comprises a strap 210 and a fastener 211, the strap 210 having a receiving hole 212 coupled to the groove 24 of the lens frame 20. The fastener 211 is a tab that has two through holes 213 on opposite side for positioning and receiving both ends of the strap 210. In addition, a flexible thread connection element

Figure 2:
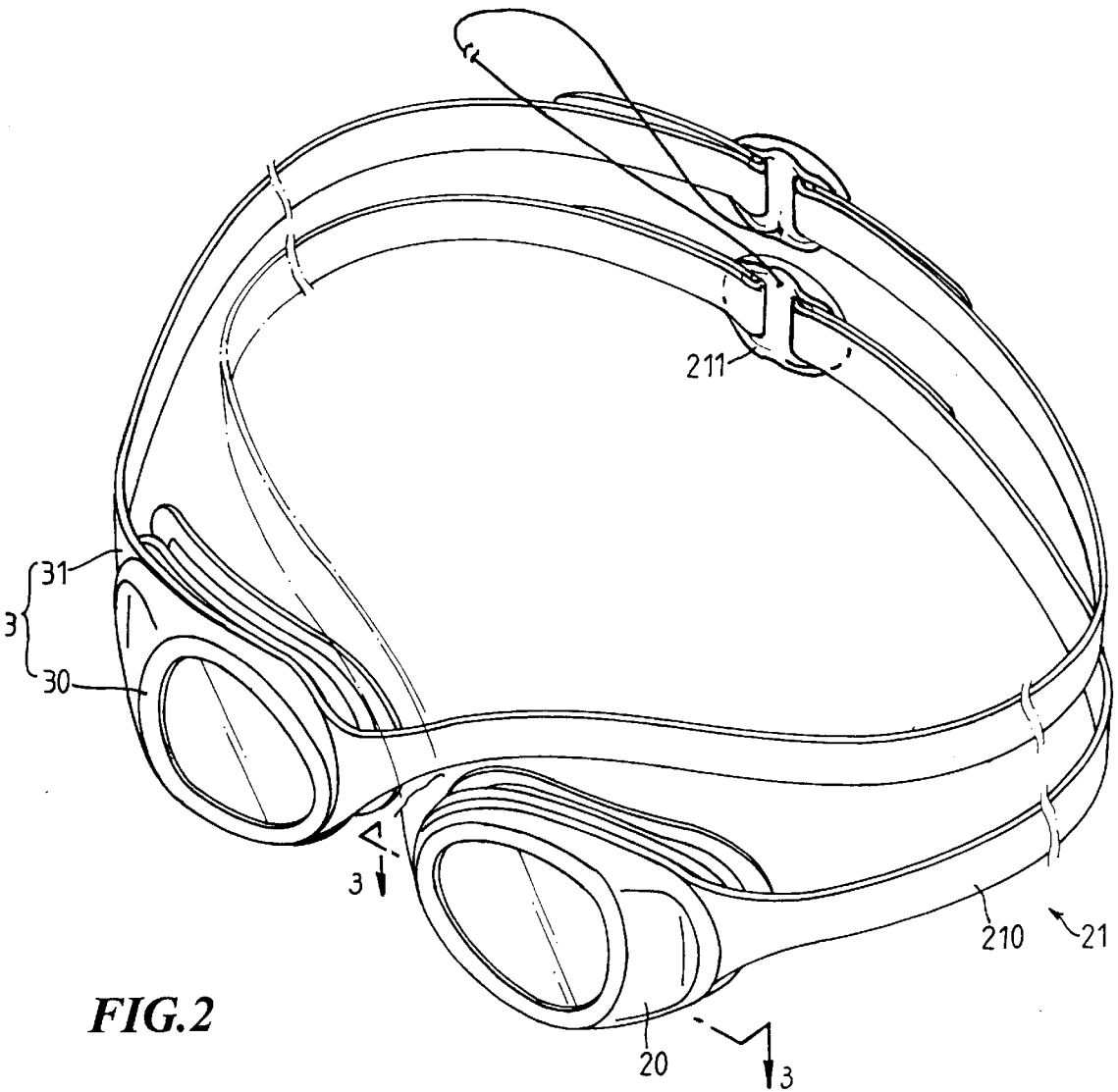
FIG. 2 is a perspective view of the dual single-eye swimming goggles of the present invention.
Figure 3:
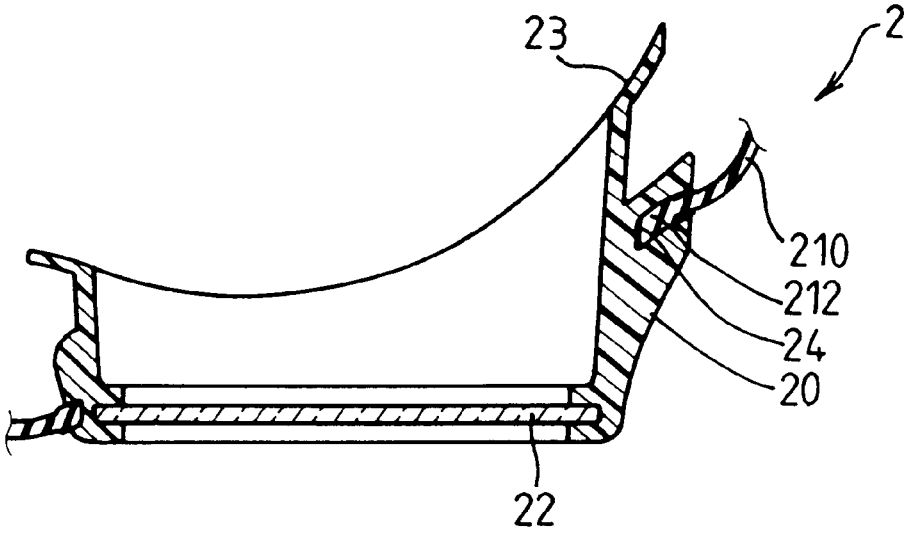
FIG. 3 is a cross-sectional view of the A—A section of FIG. 2.

25 having two ends which are respectively disposed on the fastener 211 of each head strap means 21 for linking them together, the flexible thread connection element 25 is 10 cm in this embodiment of the present invention. With reference to FIG. 2 is a perspective view of the dual single-eye swimming goggles of the present invention. During assembly, as shown in FIG. 3, the lens unit 22 is implanted and fixed onto the inner periphery 201 of the lens frame 20, and then the receiving hole 212 of the strap 210 is coupled to the groove 24 of the lens frame 20, finally, two ends of the strap 210 are respectively passed through and received on the through holes 213 of the fastener 211, the single-eye swimming goggle 2 of the present invention is ready for use at this time.

Figure 4:
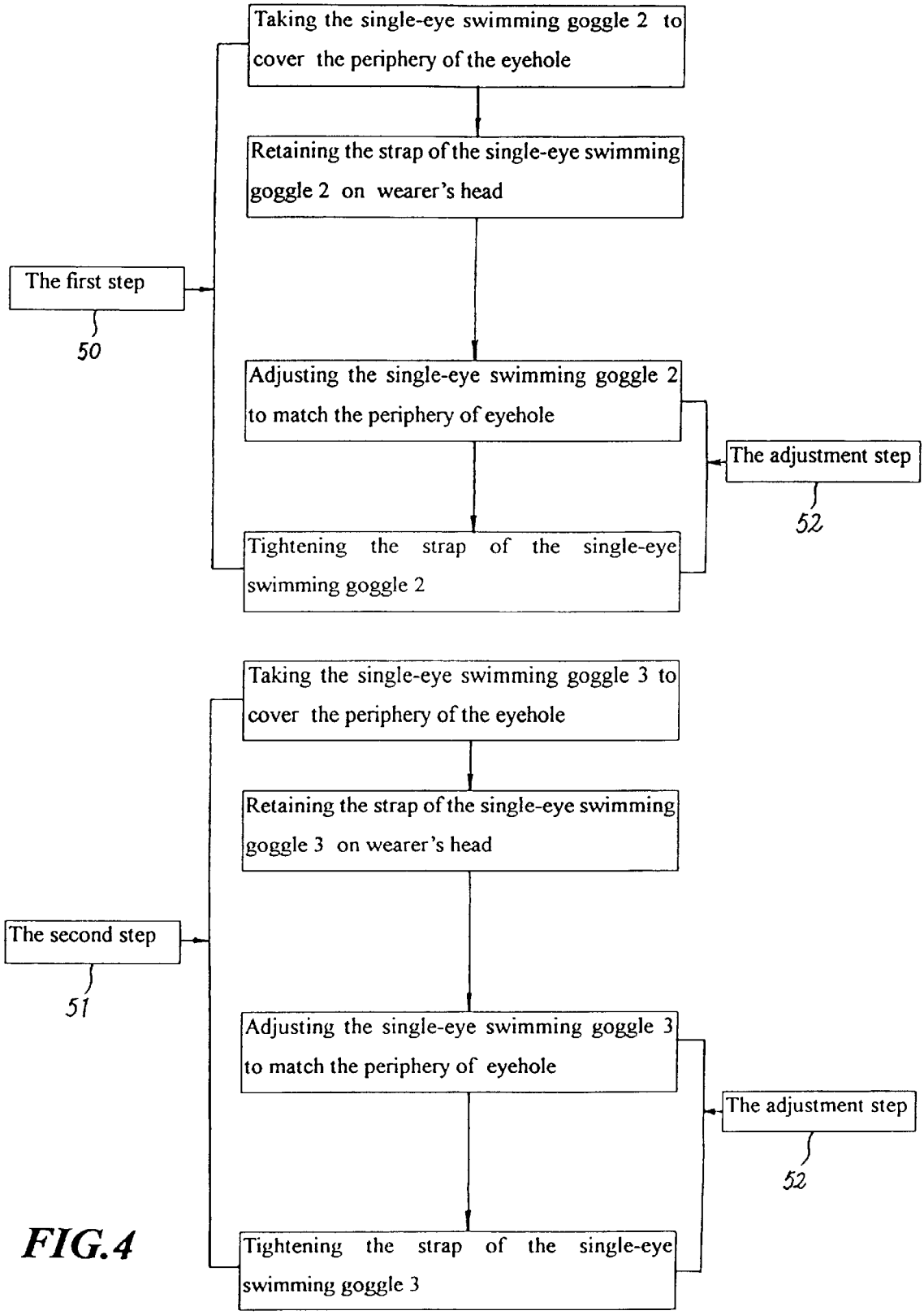
FIG. 4 is flow sheet view of the method which wear the dual single-eye swimming goggles system of the present invention.
Figure 5:
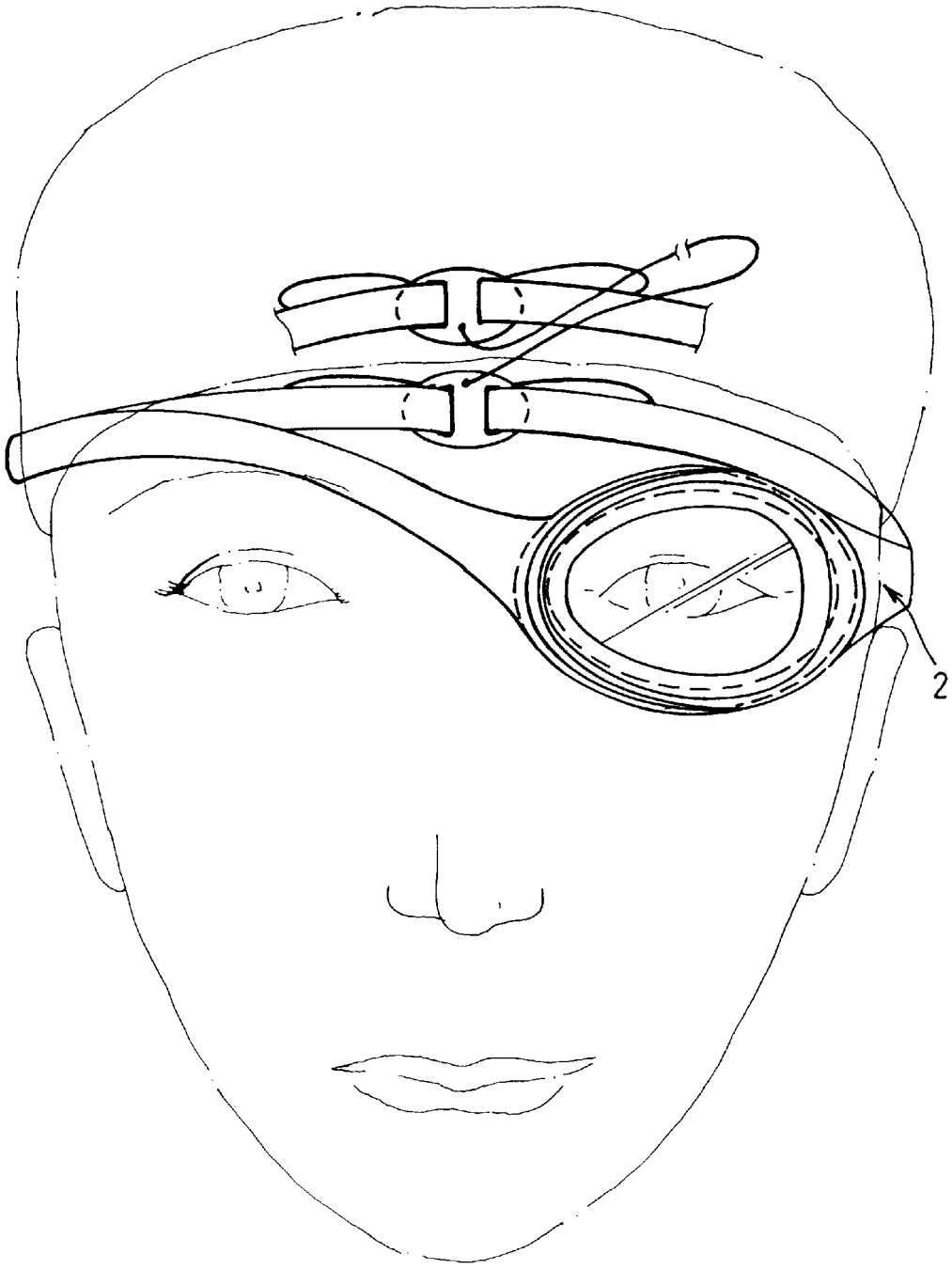
FIGS. 5, 6 is a front view of the dual single-eye swimming goggle with a wearing step embodiment of the present invention.
Figure 6:
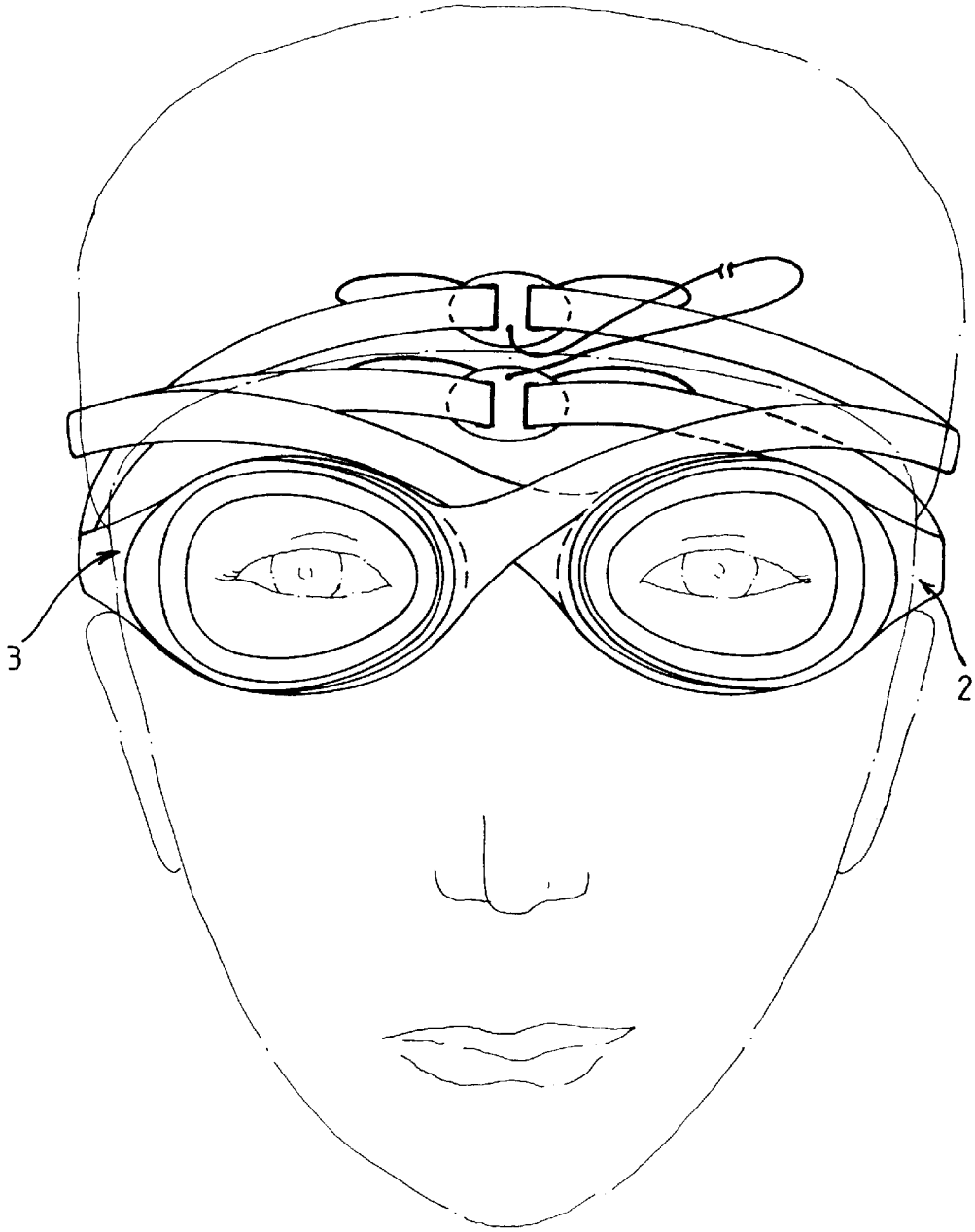

As shown in FIG. 4, while wearing, there are three steps could be done comprising a first step 50, a second step 51 and an adjusting step 52, the first step 50 includes taling the first single-eye swimming goggle 2 to cover the periphery of a wearer's eyehole as shown in FIG. 5, and then, retaining the strap 210 on the user's head. The adjusting step 52 includes adjusting the single-eye swimming goggle 2 to match with the wearer's eyehole contour and positioning the strap 210 on the wearer's head. Therefore, the single-eye swimming goggle 2 may be quite conformity with a wearer's single-eye contour and get more comfortable after wear. The second step 51 is generally similar to the first step 50, it also could be easily adjusted and positioned on the wearer's head as shown in FIG. 6, so as to get more comfortable and prevent the seepage of water.

While the present invention has been described in connection with what is considered the most practical and preferred embodiment, it is understood that this invention is not limited to the disclosed embodiments but is intended to cover various arrangements ,which a head strap is integrally formed with each lens frame respectively, or to change the way of wearing the dual single-eye on the eyehole in use, included within the spirit and scope of the broadest interpretation so as to encompass all such modifications and equivalent arrangements.

What is claimed is:

1. A dual single-eye swimming goggles system comprising:

a first single-eye swimming goggle and a second single-eye swimming goggle, each single-eye swimming goggle having a lens frame, a lens fixed in the lens frame, and a head strap means mounted to the lens frame, wherein:

each said lens frame has a groove formed in an outer periphery thereof, each said head strap means comprises a strap and a fastener, said strap having a receiving hole coupled to the groove of the lens frame and having two ends passing through said fastener, such that each single-eye swimming goggle being adjustable independently of the other single-eye swimming goggle to match the periphery of a wearer's eyehole.

2. The dual single-eye swimming goggles system as claimed in claim 1, wherein said fastener is a tab that has at least two through holes on opposite sides for positioning and receiving both ends of the strap.

3. The dual single-eye swimming goggles system as claimed in claim 1, further comprising a flexible thread connection element having two ends which are respectively disposed on the fastener of each head strap means for linking them together.

4. A dual single-eye swimming goggles system comprising:

a first single-eye swimming goggle and a second single-eye swimming goggle, each single-eye swimming goggle having a lens frame which includes an integrally formed gasket near a face-contacting side of the lens frame, a lens fixed in the lens frame, and a head strap means mounted to the lens frame, wherein:

each said lens frame has a groove formed in an outer periphery thereof, each said head strap means comprises a strap and a fastener, said strap having a receiving hole coupled to the groove of the lens frame and having two ends passing through said fastener, such that each single-eye swimming goggle being adjustable independently of the other single-eye swimming goggle to match the periphery of a wearer's eyehole.

5. A single-eye swimming goggle comprising:

a lens frame, a lens fixed in the lens frame, and a head strap means mounted to the lens frame, wherein:

said lens frame has a groove formed in an outer periphery thereof, said head strap means comprises a strap and a fastener, said strap having a receiving hole coupled to the groove of the lens frame and having two ends passing through said fastener.

6. The single-eye swimming goggle as claimed in claim 5, wherein said fastener is a tab that has at least two through holes on opposite sides for positioning and receiving both ends of the strap.

7. A single-eye swimming goggle comprising:

a lens frame, which includes an integrally formed gasket near a face-contacting side of the lens frame, a lens fixed in the lens frame, and a head strap means mounted to the lens frame, wherein:

said lens frame has a groove formed in an outer periphery thereof, said head strap means comprises a strap and a fastener, said strap having a receiving hole coupled to the groove of the lens frame and having two ends passing through said fastener.

* * * * *